US007137523B2

(12) United States Patent
Holm et al.

(10) Patent No.: US 7,137,523 B2
(45) Date of Patent: Nov. 21, 2006

(54) OPENING DEVICE

(75) Inventors: Henrik Holm, Lund (SE); Lennart Stillerud, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/433,685

(22) PCT Filed: Jun. 8, 2001

(86) PCT No.: PCT/SE01/01302

§ 371 (c)(1),
(2), (4) Date: Jun. 5, 2003

(87) PCT Pub. No.: WO02/070365

PCT Pub. Date: Sep. 12, 2002

(65) Prior Publication Data

US 2004/0026421 A1 Feb. 12, 2004

(30) Foreign Application Priority Data

Dec. 22, 2000 (SE) ..... 0004864

(51) Int. Cl.
*B65D 51/20* (2006.01)
*B65D 17/34* (2006.01)

(52) U.S. Cl. ..... 220/258.2; 220/276; 222/541.9

(58) Field of Classification Search ..... 215/254; 220/276, 258.2, 270; 222/541.9
See application file for complete search history.

(56) References Cited

U.S. PATENT DOCUMENTS

| | | | | | |
|---|---|---|---|---|---|
| 708,528 | A | * | 9/1902 | Calleson | 215/254 |
| 3,567,061 | A | * | 3/1971 | Song | 220/270 |
| 3,661,306 | A | * | 5/1972 | Kuckens | 222/504 |
| 3,834,597 | A | * | 9/1974 | Guala | 222/525 |
| 4,687,116 | A | * | 8/1987 | Dutt et al. | 220/270 |
| 4,702,387 | A | * | 10/1987 | Wombold | 220/270 |
| 4,913,306 | A | * | 4/1990 | Piltz | 220/270 |
| 4,934,585 | A | | 6/1990 | Reil | |
| 4,961,511 | A | * | 10/1990 | Piltz | 220/270 |
| 6,142,334 | A | * | 11/2000 | Kristensson | 220/270 |
| 6,464,096 | B1 | * | 10/2002 | Adams et al. | 220/258.2 |

* cited by examiner

*Primary Examiner*—Nathan J. Newhouse
*Assistant Examiner*—James Smalley
(74) *Attorney, Agent, or Firm*—Buchanan Ingersoll & Rooney LLP

(57) ABSTRACT

An opening device comprising a removable membrane (11) connected to a pulling device (12). The pulling device (12) is connected to the membrane (11) at its opposed ends (13, 14) so as to define a pull ring. Weakening arrangements (15, 16) are provided at said opposed ends to initiate the tearing off of the membrane.

15 Claims, 6 Drawing Sheets

OPENING DEVICE

FIELD OF THE INVENTION

The present invention relates to an opening device of the type defined in the preamble of claim 1.

BACKGROUND OF THE INVENTION

Today, for milk, juice and other beverages, there exists a number of types and sizes of consumer packages, e.g. Parallel epidemic packages of laminated paper/plastic, blow moulded bottles or cups made solely of plastic and different kinds of containers made of glass, sheet metal or aluminium. A number of these different kinds of packages comprise some kind of opening device in order to facilitate the access of the consumer to the contents of the package either for pouring into a drinking-vessel or for consumption directly from the package. In case of packages formed as bottles, a common solution is some kind of screw cap, while packages formed from plastic or laminated paper/plastic often comprise a simple tear notch or a pre-made pouring opening covered by a strip adapted to be torn off, a so-called pull-tab. Separately made opening devices of thermoplastic material, e.g. injection moulded opening devices with a pouring edge or a short neck and a snap or screw cap are also known. This kind of opening devices can also be injection moulded in situ, i.e. around an opening punched from the packaging material such that this opening is closed until the consumer opens the opening device. Injection moulded opening devices can of course also be of different size and even cover a complete upper surface of a packaging container, whereby they also serve as a side panel of the packaging container.

Especially in case of the above mentioned injection moulded opening devices is it common to seal the pouring opening with some kind of membrane that can be torn off, which membrane on one hand guarantees that the opening device is completely tight before it is opened, and on the other hand indicates that the package has not been opened before (tamper proof). The membrane is often also utilised in case of the kind of opening devices that have a screw or snap cap for the reclosure. In order to make the removal of the membrane possible, the membrane is of the provided with some kind of grip or pull device, which makes is possible for the consumer to get a firm grip in order to especially promote the initiation of the opening. Even in cases where the membrane is demarcated from the surrounding opening device or surrounding portions of the package, the initiation of the tearing can in some cases cause difficulties, since the weakening line in spite of its obvious weakening purpose is not allowed to weaken the material in such an extent that ruptures and leakage occurs, Earlier attempts to eliminate this difficulty at the initiation of the tearing has in substance been directed towards minimising the necessary force by making sure that the weakening line has a minimal remaining material thickness, but since the manufacturing tolerances are comparatively large a relatively large material thickness must be present in order to secure that leakages do not occur. Other possibilities to facilitate the initiation of the tearing is of course to provide the grip device with a sturdy pull ring or equivalent grip that makes it possible for the consumer to apply a large pulling force on the membrane at the initiation of the tearing.

Thus, it is a common desire to provide an opening device of the above-mentioned kind, by which the initiation of the tearing of the membrane is facilitated without the occurrence of any of the above-mentioned drawbacks.

SUMMARY OF THE INVENTION

One object with the invention is therefore to provide an opening device of the above mentioned kind, which opening device is designed such that the necessary pulling force to initiate the tearing off of the membrane is facilitated without an increase of the risk for unintentional leakages.

Another object with the invention is to provide an opening device by which the membrane is easy to remove independent upon the direction in which the pulling force is applied.

Yet another object with the invention is to provide an opening device by which the risk that the pulling device will break during the tearing off of the membrane, especially during the initiation of the tearing off, is minimised.

Above mentioned and other objects have in accordance with the invention been achieved in that an opening device of the kind mentioned in the preamble of claim 1 has been given the characterising features as defined in the appended claims.

BRIEF DESCRIPTION OF THE DRAWINGS

Below, preferred embodiments of an opening device according to the invention will be described in more detail with reference to the appended drawings. These drawings only show details that are of importance in order to understand the invention.

DETAILED DESCRIPTION OF THE INVENTION

Figure 1:
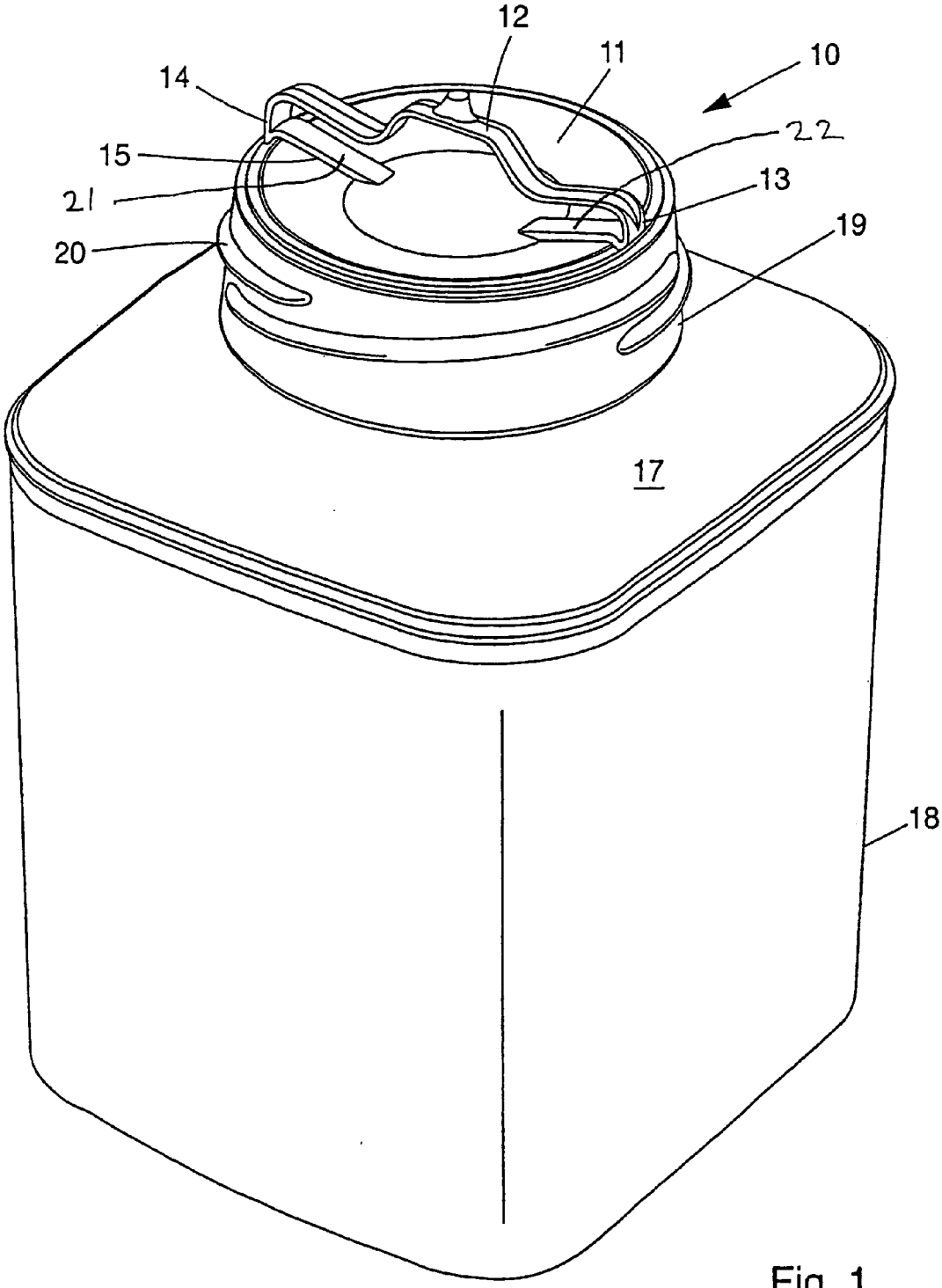
FIG. 1 shows in perspective a first embodiment of an opening device in accordance with the present invention.

The preferred embodiments of an opening device in accordance with the invention is shown in the figures in its most simple form, i.e. only details that are of importance in order to understand the invention are presented. It is however contemplated that the opening device in accordance with the invention can be integrated with different kinds opening devices known as such. Thus, the presented embodiments of the invention can e.g. be combined with different kinds of pouring edges, tubular neck portions and different kinds of outer caps, such as screw caps or snap on caps. The inventive opening device can also be placed on different side surfaces on an as such known packaging container or make up a portion of a large or small end surface of a arbitrary packaging container. The placement of the inventive opening device on the packaging container or any surrounding elements such as pouring edges, outer caps or similar, does not influence the operation of the opening device and will therefore not be described in detail in this context.

It is beneficial to use the invention in case of the kind of opening devices that make up a portion of an injection moulded end surface of a packaging container.

The shown embodiment of an opening device 10 in accordance with the invention comprises a membrane 11, which by the use of an injection moulding operation is integrated with the surrounding portions of the opening device 10. A pulling device in the form of a pulling loop 12 extends from the membrane 11 and is connected to the membrane 11 at opposing ends 13, 14 of the pulling loop 12. The membrane 11 is circular and the pulling loop 12 extends diametrically across the membrane 11. The opening device 10 is in accordance with the invention manufactured from the thermoplastic material, which is flexible, elastic and tearable along the perimeter of the membrane. In case of the shown embodiment, the opening deice 10 is integrally formed with an end surface 17 of the packaging container 18 using injection moulding. The opening device 10 is formed with a neck portion 19 provided with an external thread 20, on which a screw cap 30 is adapted to be applied. An opening device of this principal kind is shown in U.S. Pat. No. 4,934,585. Alternatively, the opening device can be applied directly to the end surface, whereby the membrane preferably is formed as a pivotal snap lid.

In accordance with a first embodiment, stiffening ridges 21, 22 are provided on the top side of the membrane 11 in conjunction with the connections 13, 14 between the pulling loop 12 and the membrane 11. Weakening lines 15, 16 is formed in the membrane 11 extending radially inwards from the connections 13, 14. In case of the embodiment as shown, the weakening lines 15, 16 are adapted to extend somewhat longer than half the radius of the membrane 11.

The weakening lines 15, 16 are adapted to extend along the opposite sides of the pulling loop 12.

Figure 2:
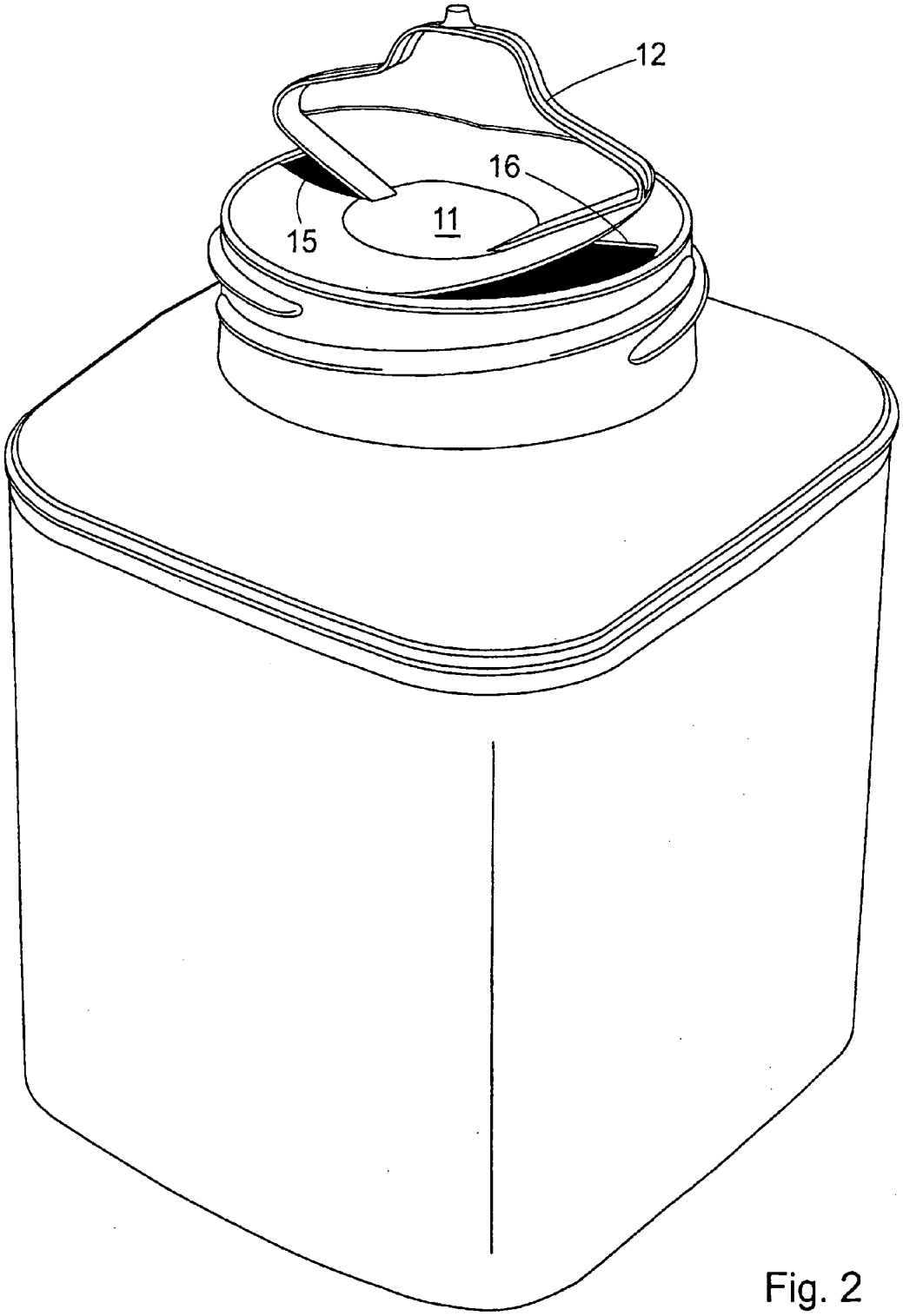
FIG. 2 shows in perspective the embodiment of FIG. 1, by which the tearing off of the membrane has been initiated.
Figure 3:
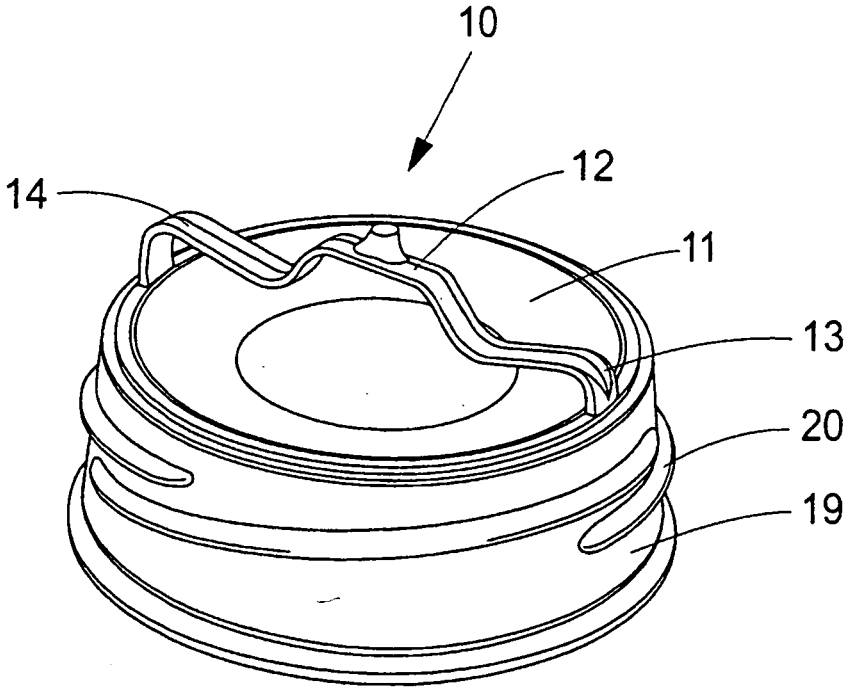
FIG. 3 shows in perspective a second embodiment of an opening device in accordance with the present invention.
Figure 4:
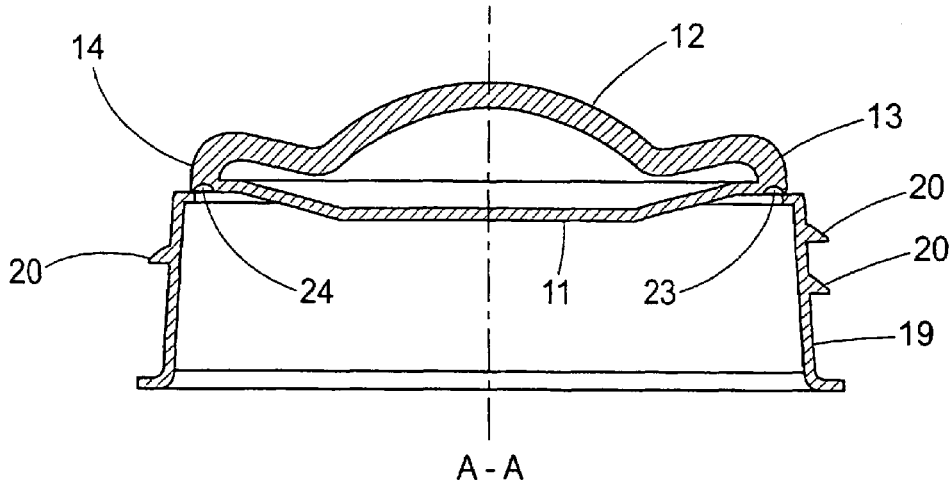
FIG. 4 shows a cross section of the embodiment of FIG. 3.
Figure 5:
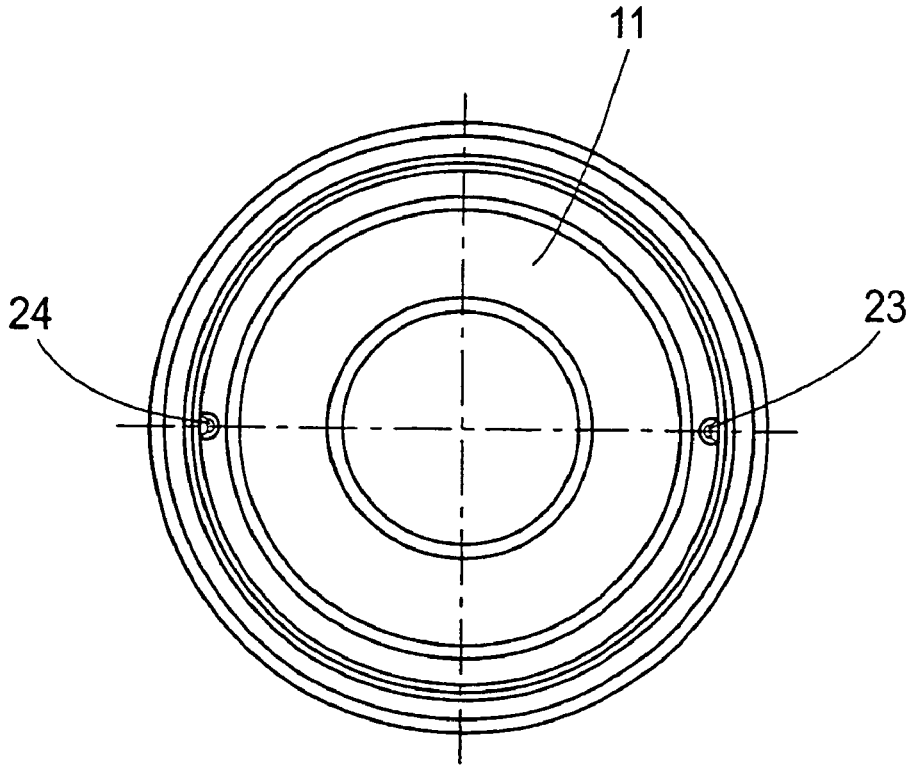
FIG. 5 shows the embodiment of FIG. 3 as seen from directly below.
Figure 6:
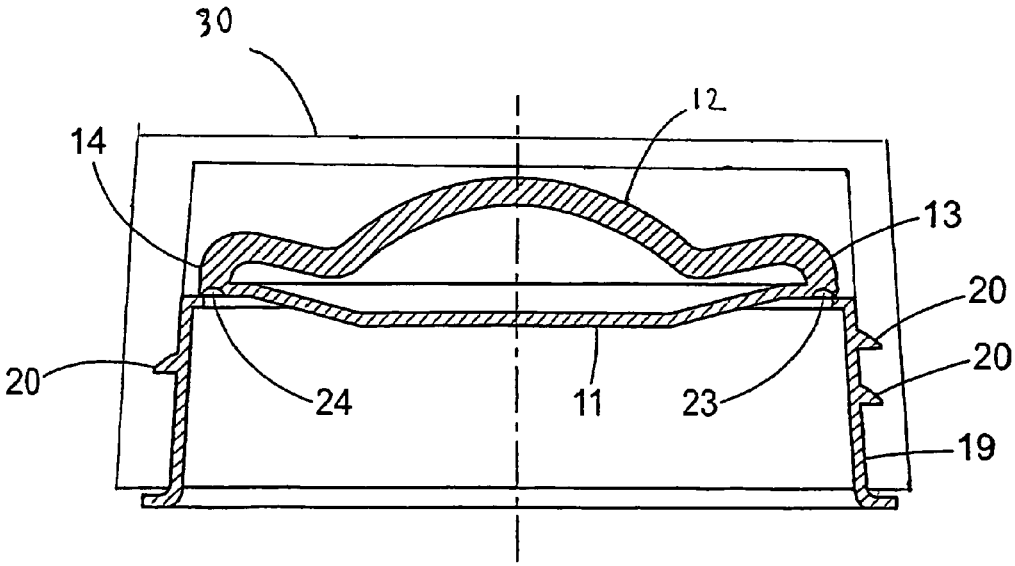
FIG. 6 shows an embodiment including a screw cap.

At the removal of the membrane 11 the consumer grips the pulling loop 12, preferably by inserting a finger through the opening formed by the pulling loop 12 and membrane 11. At the application of a pulling force, directed along the longitudinal direction of the packaging container 18, the membrane 11 will be released from the top side of the neck portion 19 at the connection points 13, 14. At first, the opening will occur along one of the weakening lines 15, 16 and along a minor portion of the perimeter of the membrane 11 in connection with said weakening line. At further application of the pulling force, the corresponding opening will occur at the other weakening line 15, 16 whereby the position as shown in FIG. 2 will be achieved. Thereafter further tearing off will occur along both portions of the perimeter where the opening has been initiated until the membrane 11 has been removed from the packaging container.

The course of events that has been described above is an ideal course of events. If the pulling force is not mainly applied in the longitudinal direction of the packaging container, the opening could be initiated at one of the points of connections 13, 14 as described above, whereby further tearing off could occur along the perimeter of the membrane along in about half the perimeter of the membrane. Thereafter further tearing off will occur on one hand along said perimeter of the membrane and on the other hand along tearing off along the perimeter in the opposite direction from said one point of connection.

In accordance with the invention it is secured that the initiation of the tearing off occurs at least at one of the points of connection 13, 14 independent upon the direction of the application of the pulling force, without the risk that the pulling ring 12 come loose from its connection to the membrane 11. At the application of a side wise directed pulling force, the pulling ring 12 will act as a lever such that the opening will be initiated along the weakening line 15, 16 being arranged on the opposite side of the stiffening ridges 21, 22 in relation to the application of the pulling force.

The invention claimed is:

1. Opening device for a package comprising a removable membrane and a pulling device connected to the membrane, wherein the pulling device extends at least over a portion of the membrane and wherein the pulling device at its opposing end portions is fixedly connected to a portion of the membrane for the formation of a pulling loop in order to make removal of the membrane possible, and wherein means for facilitating the initial tearing off of the membrane is provided at said end portions, said means comprising a pair of weakening lines in the membrane, which each extend inwardly away from a periphery of the membrane, each weakening line extending from adjacent the portion of the membrane at which one of the end portions of the pulling device is fixedly connected to the membrane, the weakening lines acting as initial points of break when a pulling force is applied to the pulling loop, wherein the membrane extends across an opening in the container to prevent fluid communication between an environment inside the container and an environment outside the container when the membrane is attached, and upon pulling of the pulling device the membrane tears thereby allowing fluid communication between the environment inside the container and the environment outside the container.

2. Opening device according to claim 1, wherein said membrane is circular and the weakening lines extend radially inwardly.

3. Opening device according to claim 2, wherein the length of each of the weakening lines is in the same order as half the radius of the circular membrane.

4. Opening device according to claim 1, wherein the membrane is circular and wherein the pulling device extends diametrically across the membrane.

5. Opening device according to claim 4, wherein the weakening lines extend along opposite sides of the pulling device.

6. Opening device according to claim 1, wherein the opening device is injection moulded from a plastic material integrally with an end surface of the package.

7. Opening device according to claim 1, wherein the opening device comprises a screw cap covering the membrane.

8. Opening device according to claim 2, wherein the length of each of the weakening lines is longer than half the radius of the circular membrane.

9. Opening device according to claim 1, wherein the pulling device comprises two stiffening ridges, each of the weakening lines extending along one of the stiffening ridges.

10. An opening device for a package comprising a removable membrane and a pulling device comprising opposing end portions, the opposing end portions comprising a first end portion fixedly connected to the membrane at a first connection location of the membrane and a second end portion connected to the membrane at a second connection location of the membrane, the pulling device extending over at least a portion of the membrane and forming a pulling loop in order to make removal of the membrane possible, and an indent formed on an underside of the membrane at each of the first and second connection locations to form weakenings which act as initial points of break when a pulling force is applied to the pulling loop, wherein the membrane extends across an opening in the container to prevent fluid communication between an environment inside the container and an environment outside of the container when the membrane is attached, and upon pulling of the pulling device the membrane tears thereby allowing fluid communication between the environment inside the container and the environment outside the container.

11. Opening device according to claim 10, further comprising an upstanding neck portion provided with an external thread.

12. Opening device according to claim 10, wherein the indents each have an extension in a geometrical plane of the membrane that is smaller than a corresponding extension of the first and second connection locations.

13. Opening device according to claim 10 wherein the membrane is circular and the pulling device extends diametrically across the membrane.

14. Opening device according to claim 1, wherein the opposing end portions of the pulling device include a first end fixedly connected to a portion of the membrane at a first location and a second end fixedly connected to a portion of the membrane at a second location, the first and second location being spaced apart from one another and the pulling device being unconnected to the membrane at locations between the first and second locations.

15. Opening device according to claim 10, wherein the opposing end portions of the pulling device include a first end fixedly connected to a portion of the membrane at a first location and a second end fixedly connected to a portion of the membrane at a second location, the first and second location being spaced apart from one another and the pulling device being unconnected to the membrane at locations between the first and second locations.

* * * * *